US008146970B2

(12) United States Patent
Yu

(10) Patent No.: US 8,146,970 B2
(45) Date of Patent: Apr. 3, 2012

(54) RECOVERY NET

(76) Inventor: Tien-Chih Yu, Gongliao Township, Taipei County (TW)

( * ) Notice: Subject to any disclaimer, the term of this patent is extended or adjusted under 35 U.S.C. 154(b) by 164 days.

(21) Appl. No.: 12/720,594

(22) Filed: Mar. 9, 2010

(65) Prior Publication Data

US 2011/0081814 A1 Apr. 7, 2011

(30) Foreign Application Priority Data

Oct. 1, 2009 (TW) ..... 98133350 A

(51) Int. Cl.
*B63C 7/00* (2006.01)
*B66C 1/12* (2006.01)

(52) U.S. Cl. ..... 294/77; 441/80

(58) Field of Classification Search ..... 43/7, 9.1, 43/9.4, 9.5, 9.8; 294/77, 156; 441/80, 83; 114/240 C, 241; 182/138
See application file for complete search history.

(56) References Cited

U.S. PATENT DOCUMENTS

| | | | | |
|---|---|---|---|---|
| 1,337,920 | A * | 4/1920 | Kohler | 114/240 R |
| 1,485,338 | A * | 2/1924 | Skrmetti | 43/9.1 |
| 3,165,853 | A * | 1/1965 | Ansell | 43/7 |
| 4,564,161 | A * | 1/1986 | Frye | 244/137.2 |
| 4,652,246 | A | 3/1987 | Thorgeirsson et al. | |
| 5,158,489 | A * | 10/1992 | Araki et al. | 441/80 |
| 5,320,566 | A | 6/1994 | Low, Jr. | |
| 5,370,565 | A | 12/1994 | Yanez | |
| 5,779,511 | A * | 7/1998 | Davidson, Jr. | 441/80 |
| 7,238,074 | B1 * | 7/2007 | Berndt et al. | 441/80 |

FOREIGN PATENT DOCUMENTS

| | | | |
|---|---|---|---|
| DE | 1126761 | B | 3/1962 |
| DE | 3809264 | A1 | 9/1989 |
| DE | 19631672 | A1 | 2/1998 |
| DE | 202004015626 | U1 | 2/2005 |
| GB | 2240748 | A | 8/1998 |
| WO | 2009036494 | A1 | 3/2009 |

* cited by examiner

*Primary Examiner* — Dean Kramer
(74) *Attorney, Agent, or Firm* — patenttm.us

(57) ABSTRACT

A recovery net has a net, a connecting rope, a floating unit, a ballast and two pulling ropes. The net has an upper edge, a lower edge and a surface. The connecting rope and the floating unit are mounted on the upper edge of the net. The ballast and the pulling ropes are mounted on the lower edge of the net. The floating unit provides buoyancy, the ballast provides sinking force so the net can float on water and the surface of the net is vertical. Recoverers align the net near a corpse and then pull the pulling ropes to recover the corpse in its entirety so recovery work is more efficient.

16 Claims, 7 Drawing Sheets

RECOVERY NET

BACKGROUND OF THE INVENTION

1. Field of the Invention

The present invention relates to a recovery device, and more particularly to a recovery net to facilitate recovery.

2. Description of the Prior Arts

Recovery devices are used to retrieve corpses from water and include recovery rings. A recovery ring has a telescopic rod connected to a ring. In recovery work, the rod is adjusted to a suitable length and the ring is used to support and pull a corpse nearer. Then, recoverers enter the water and place a floating stretcher under the corpse for lifting onto a boat.

Since the corpse may have been immersed in water for long the corpse may be fragile and swollen, so the ring may break up the corpse so hindering recovery efforts. Besides, entering the water during bad weather with rough seas is dangerous.

To overcome the shortcomings, the present invention provides a recovery net to mitigate or obviate the aforementioned problems.

SUMMARY OF THE INVENTION

The main object of the present invention is to provide a recovery net that can fully cover a corpse to facilitate recovery.

A recovery net comprises a net, a connecting rope, a floating unit, a ballast and two pulling ropes. The net has an upper edge, a lower edge and a surface. The connecting rope and the floating unit are mounted on the upper edge of the net. The ballast and the pulling ropes are mounted on the lower edge of the net. The floating unit provides buoyancy, the ballast sinks the net so the net floats vertically. Recoverers float the net near a corpse and pull the pulling ropes to fully cover the corpse. Therefore the corpse can be recovered in its entirety and recovery is more efficient.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
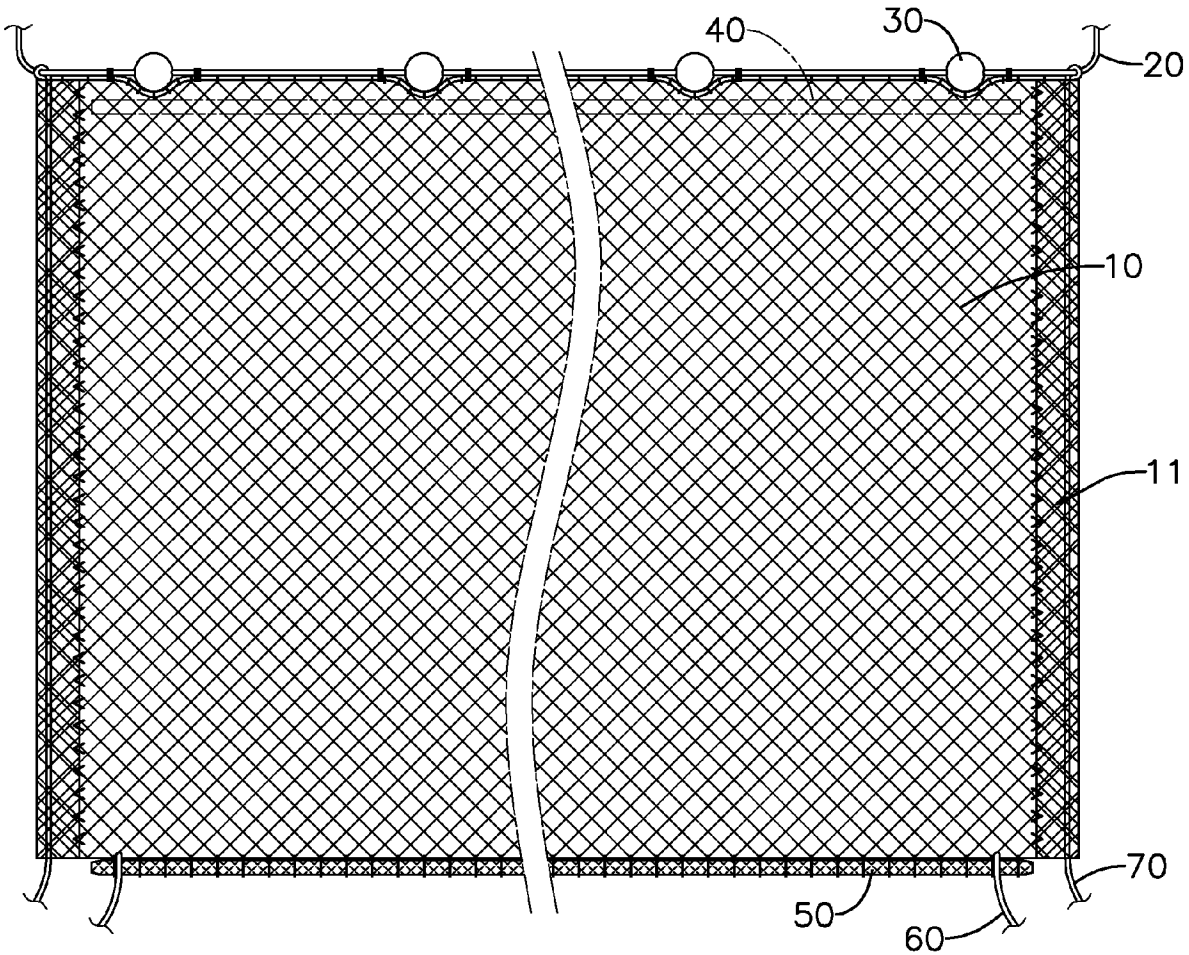
FIG. 1 is a front view of a recovery net in accordance with the present invention.
Figure 2:
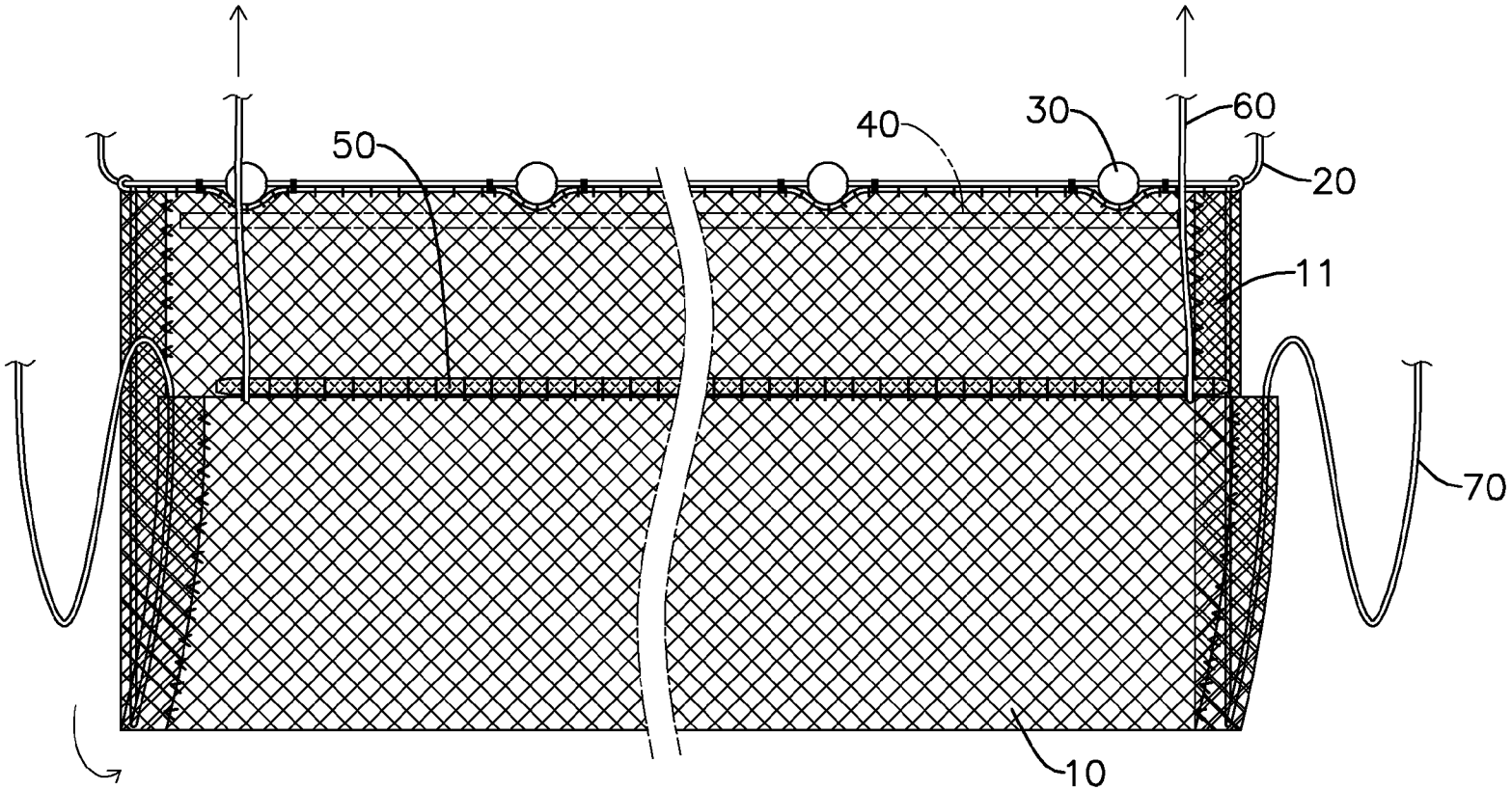
FIG. 2 is an operational front view of the recovery net in FIG. 1, showing pulling ropes pulled.

With reference to FIGS. 1 and 2, a recovery net in accordance with the present invention comprises a net (10), a connecting rope (20), a floating unit (30), a rod (40), a ballast (50), two pulling ropes (60) and two tightening ropes (70).

The net (10) has an upper edge, a lower edge, a surface and two sides respectively sewed to encircle two elongated holes (11).

The connecting rope (20) is bound on the upper edge of the net (10), may be connected to the net (10) by sewing and has two ends respectively protruding from the sides of the net (10).

The floating unit (30) provides buoyancy, is mounted on the upper edge of the net (10) and is connected to the connecting rope (20). The floating unit (30) may comprise multiple float balls.

The rod (40) is mounted on the net (10) near the floating unit (30). The rod (40) braces the net (10) and prevents the net (10) from tangling.

The ballast (50) is bound on the lower edge of the net (10) and may be connected to the net (10) by sewing. The ballast (50) provides sinking force less than the buoyancy of the floating unit (30). The ballast (50) may be a lead rope mounted parallel to the rod (40).

The pulling ropes (60) are respectively connected to the ballast (50) and are mounted respectively near the sides of the net (10). Each pulling rope (60) has a holding end far away from the ballast (50).

The tightening ropes (70) are respectively mounted through the elongated holes (11) of the net (10) and each tightening rope (70) has two ends. One end of each tightening rope (70) is connected to the connecting rope (20). The other end of each tightening rope (70) protrudes out of the corresponding elongated hole (11) of the net (10).

Figure 4:
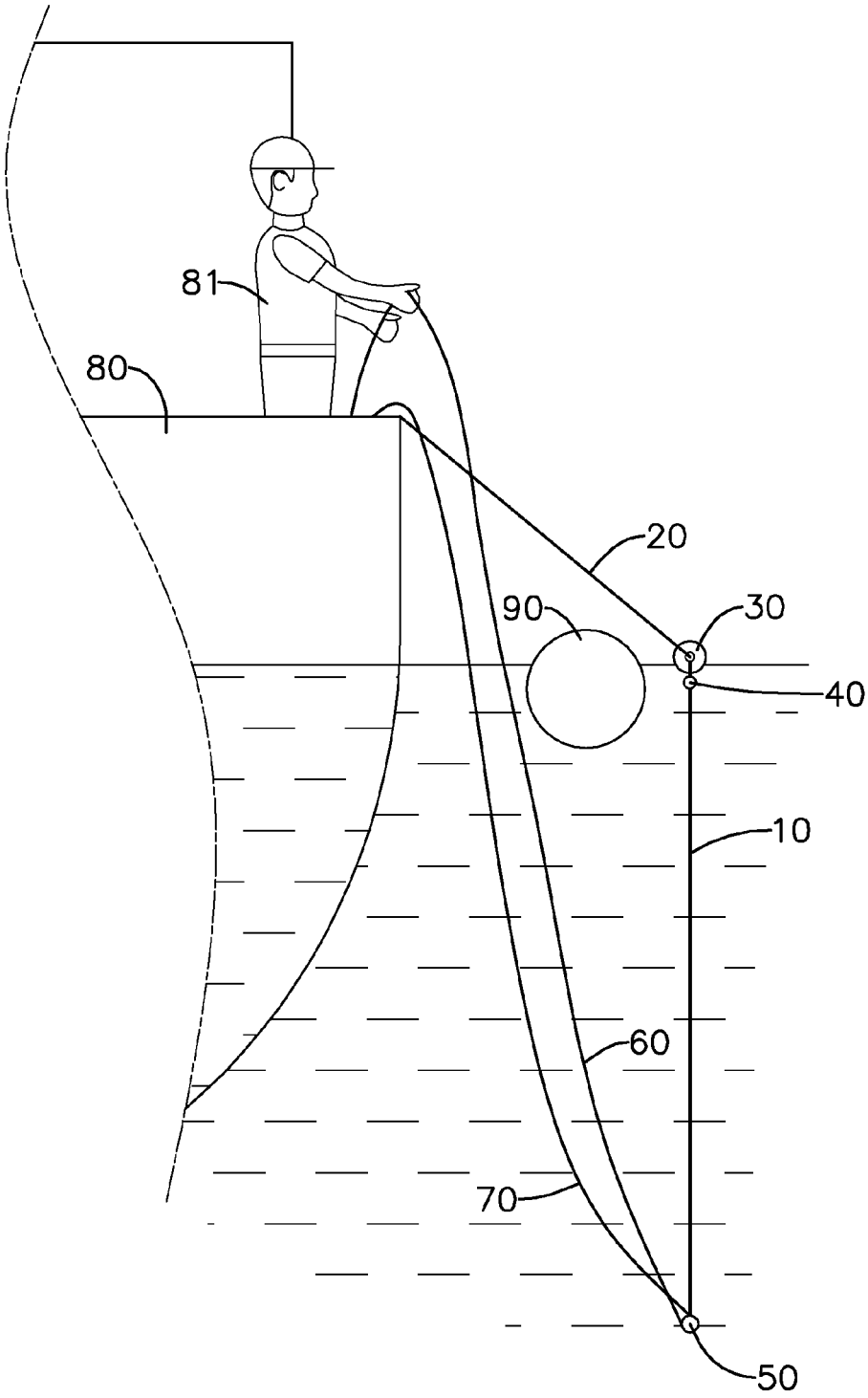
FIG. 4 is a schematic view in actual use of the recovery net in FIG. 1.

With reference to FIG. 4, in recovery work on water, such as sea, river or lake, the recoverers (81) in a rescue boat (80) put the net (10) into the water and align a corpse (90) between the net (10) and the rescue boat (80). The ends of the connecting rope (20), the holding ends of the pulling ropes (60) and the ends of the tightening ropes (70) protruding from the net (10) are held in the rescue boat (80). Due to the buoyancy of the floating unit (30) and the weight of the ballast (50), the lower edge of the net (10) is substantially perpendicular to a surface of the water while the upper edge of the net (10) floats on the water.

Figure 5:
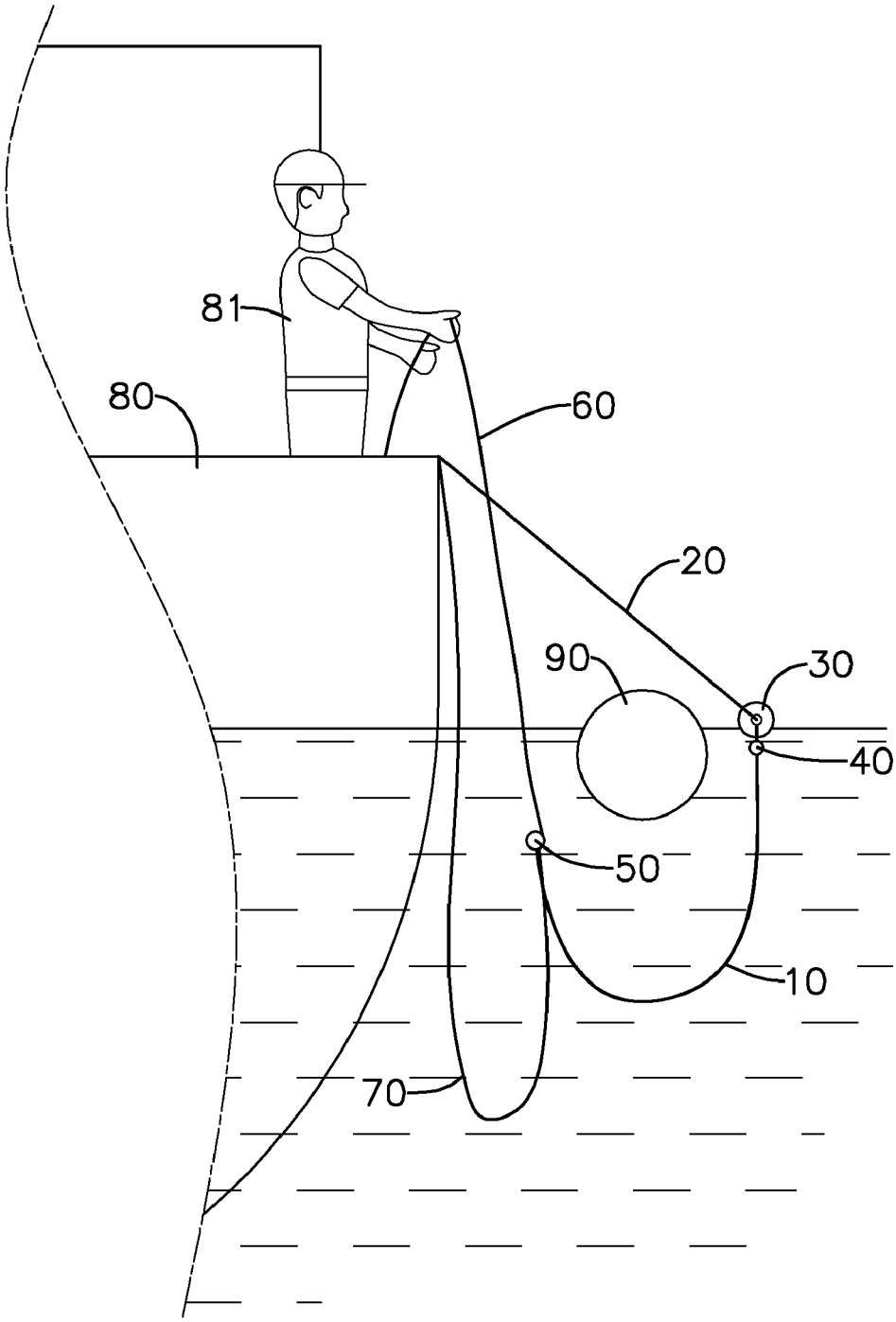
FIG. 5 is a schematic view in actual use of the recovery net in FIG. 1, showing the pulling ropes pulled.

With further reference to FIGS. 2 and 5, the recoverers (81) pull the pulling ropes (60) to lift the lower edge of the net (10) up so that the corpse (90) is placed on the net (10).

Figure 3:
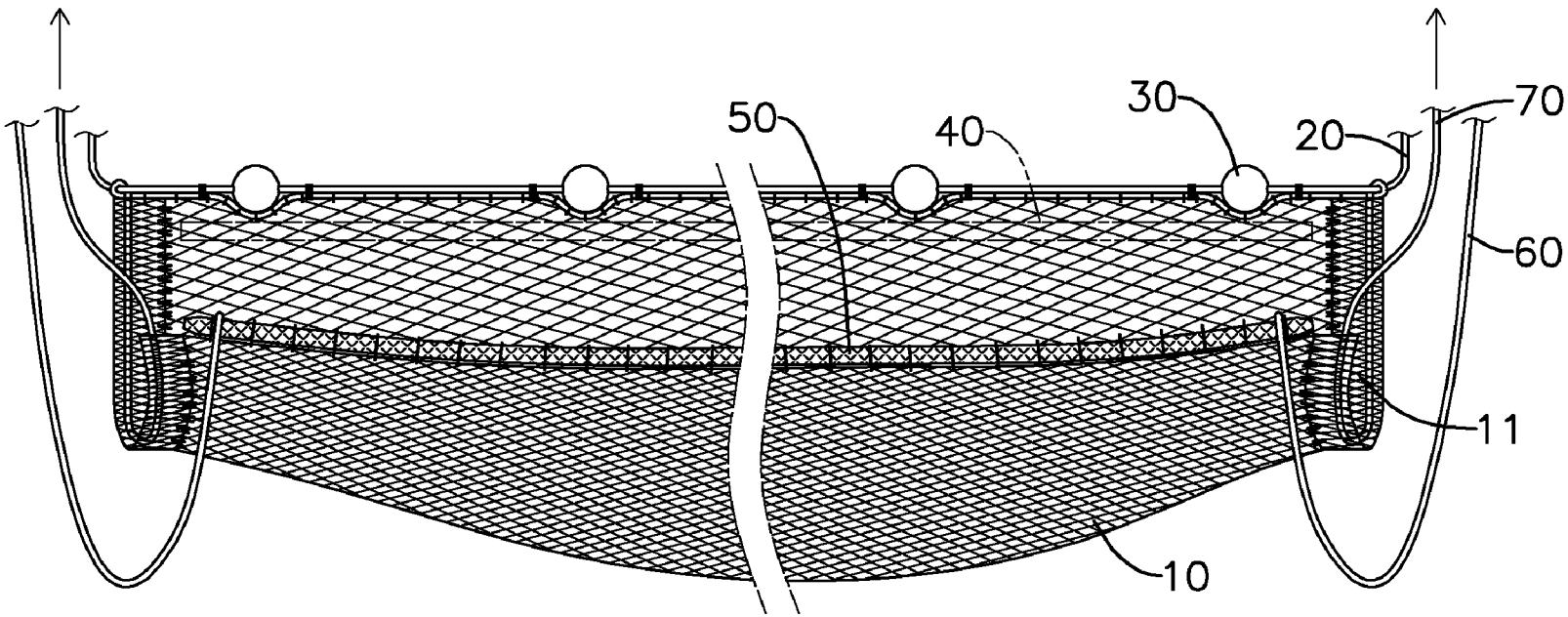
FIG. 3 is an operational front view of the recovery net in FIG. 1, showing tightening ropes pulled.
Figure 6:
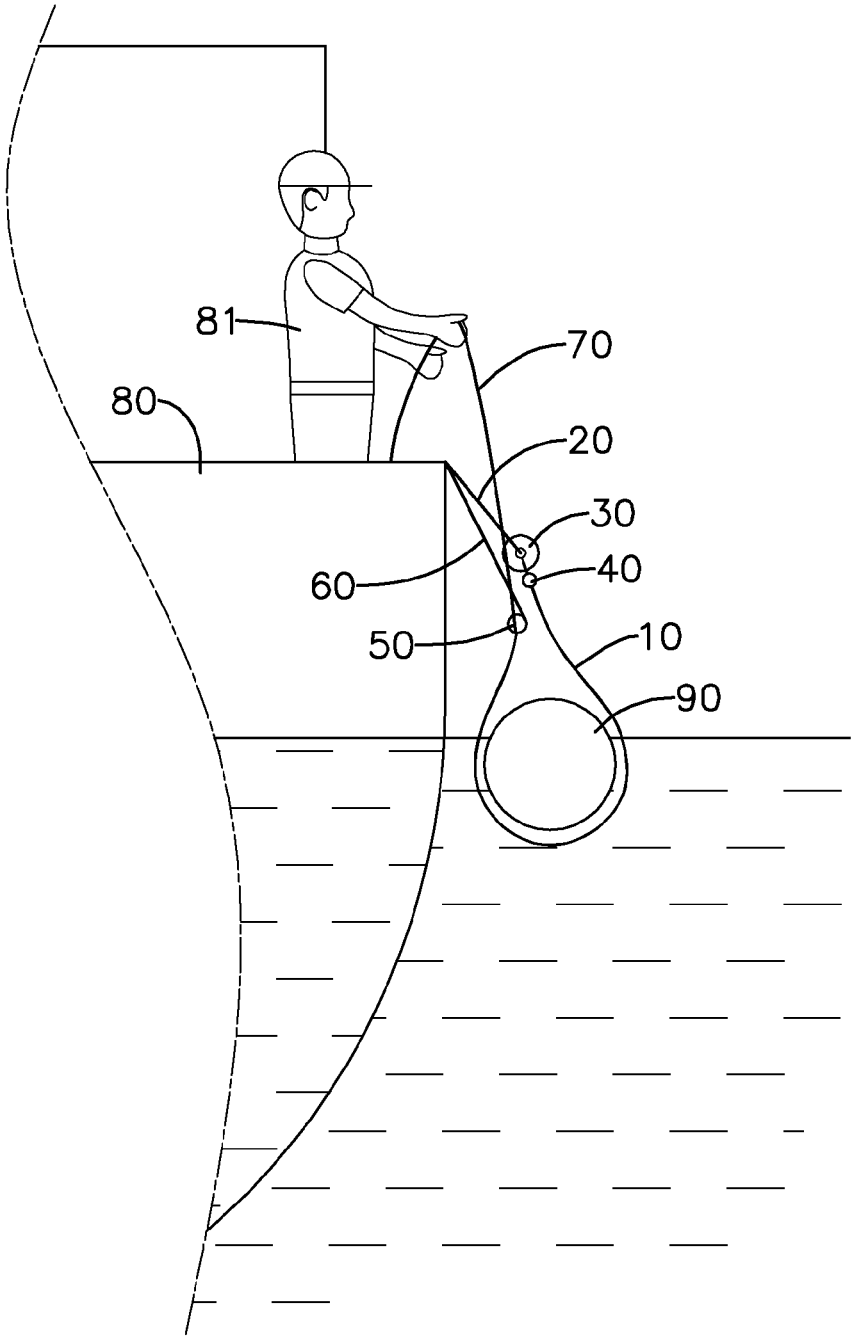
FIG. 6 is a schematic view in actual use of the recovery net in FIG. 1, showing the tightening ropes pulled.

With further reference to FIGS. 3 and 6, the recoverers (81) then pull the tightening ropes (70) to close the sides of the net (10) so that the corpse (90) is surrounded by the net (10).

Figure 7:
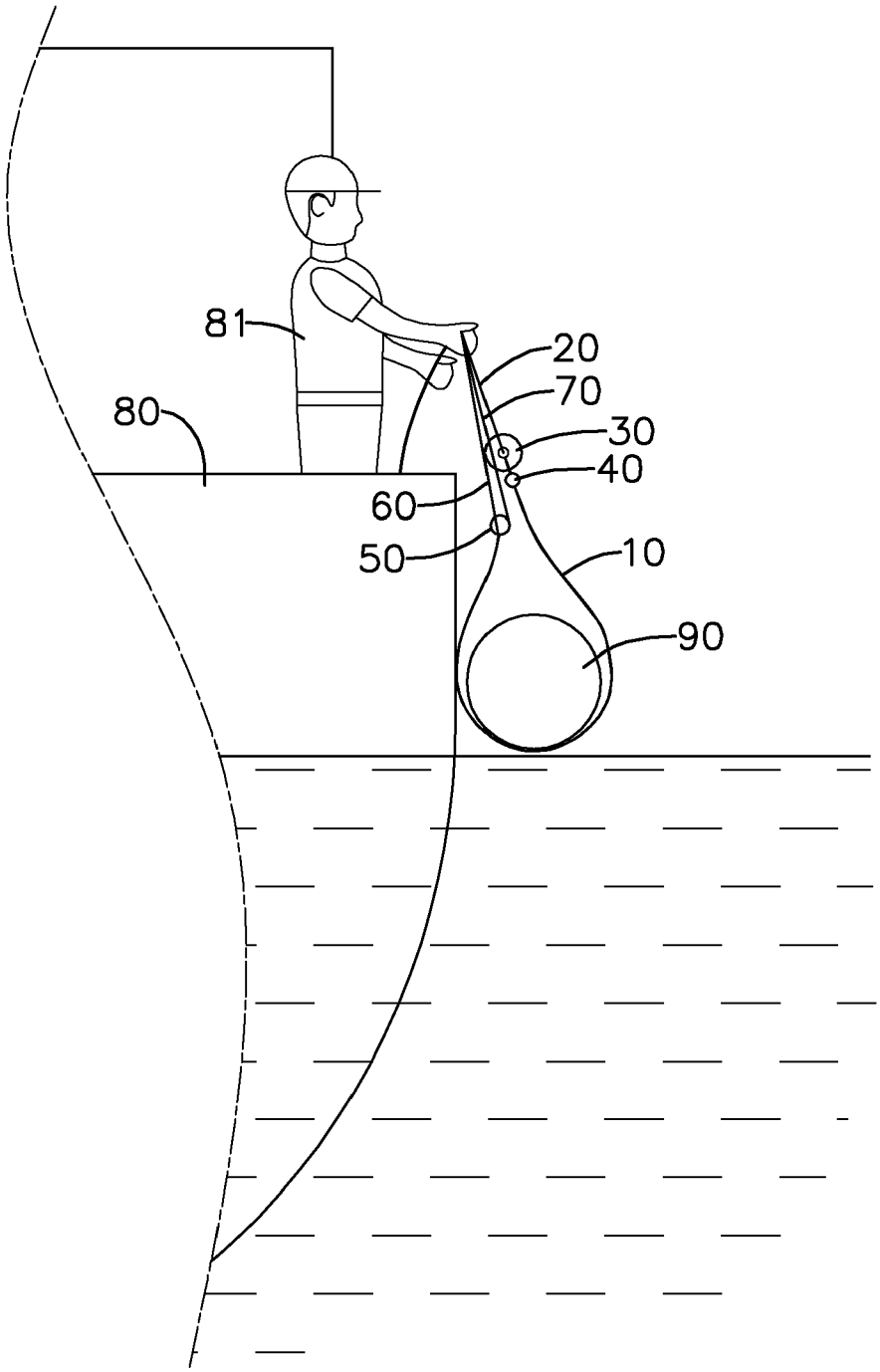
FIG. 7 is a schematic view in actual use of the recovery net in FIG. 1, showing a connecting rope, the pulling ropes and the tightening ropes pulled.

With further reference to FIG. 7, the recoverers (81) finally pull the connecting rope (20), the pulling ropes (60) and the tightening ropes (70) synchronously to pull the net (10) with the corpse (90) into the rescue boat (80).

Therefore, the corpse (90) is recovered in its entirety due to being fully covered by the net (10) and recovery work is more efficient. Besides, the recoverers (81) do not have to enter water so the recoverers (81) can work in a safe environment.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A recovery net comprising:

a net having an upper edge, a lower edge and two sides;

a connecting rope bound on the upper edge of the net and having two ends respectively protruding from the sides of the net;

a floating unit mounted on the upper edge of the net and having buoyancy;

a ballast bound on the lower edge of the net and having a weight imparting a force smaller than the buoyancy of the floating unit;

two pulling ropes respectively connected to the ballast and mounted respectively near the sides of the net and each pulling rope having a holding end far away from the ballast; and two tightening ropes respectively mounted on the sides of the net and each tightening rope having two ends, one end of each tightening rope connected to the connecting rope and the other end of each tightening rope protruding out of a corresponding side of the net and pulled to close the side of the net.

2. The recovery net as claimed in claim 1 further having a rod mounted on the net near the floating unit.

3. The recovery net as claimed in claim 2, wherein the ballast is a lead rope disposed parallel to the rod.

4. The recovery net as claimed in claim 3, wherein the net further has two elongated holes respectively formed on the sides of the net; and the tightening ropes are respectively mounted through the elongated holes of the net.

5. The recovery net as claimed in claim 4, wherein the floating unit comprises multiple float balls.

6. The recovery net as claimed in claim 3, wherein the floating unit comprises multiple float balls.

7. The recovery net as claimed in claim 2, wherein the net further has two elongated holes respectively formed on the sides of the net; and the tightening ropes are respectively mounted through the elongated holes of the net.

8. The recovery net as claimed in claim 7, wherein the floating unit comprises multiple float balls.

9. The recovery net as claimed in claim 2, wherein the floating unit comprises multiple float balls.

10. The recovery net as claimed in claim 1, wherein the ballast is a lead rope.

11. The recovery net as claimed in claim 10, wherein the net further has two elongated holes respectively formed on the sides of the net; and the tightening ropes are respectively mounted through the elongated holes of the net.

12. The recovery net as claimed in claim 11, wherein the floating unit comprises multiple float balls.

13. The recovery net as claimed in claim 10, wherein the floating unit comprises multiple float balls.

14. The recovery net as claimed in claim 1, wherein the net further has two elongated holes respectively formed on the sides of the net; and the tightening ropes are respectively mounted through the elongated holes of the net.

15. The recovery net as claimed in claim 14, wherein the floating unit comprises multiple float balls.

16. The recovery net as claimed in claim 1, wherein the floating unit comprises multiple float balls.

* * * * *